US007732723B2

(12) United States Patent
Kolmonen et al.

(10) Patent No.: US 7,732,723 B2
(45) Date of Patent: Jun. 8, 2010

(54) AUXILIARY CONTACT CONFIGURATION FOR SWITCHING DEVICE

(75) Inventors: Rainer Kolmonen, Laihia (FI); Harri Mattlar, Iskmo (FI)

(73) Assignee: ABB Oy, Helsinki (FI)

( * ) Notice: Subject to any disclaimer, the term of this patent is extended or adjusted under 35 U.S.C. 154(b) by 638 days.

(21) Appl. No.: 10/585,926

(22) PCT Filed: Jan. 18, 2005

(86) PCT No.: PCT/FI2005/000029

§ 371 (c)(1),
(2), (4) Date: Apr. 6, 2007

(87) PCT Pub. No.: WO2005/069334

PCT Pub. Date: Jul. 28, 2005

(65) Prior Publication Data

US 2007/0278077 A1 Dec. 6, 2007

(30) Foreign Application Priority Data

Jan. 19, 2004 (FI) ..... 20040066

(51) Int. Cl.
*H01H 5/00* (2006.01)

(52) U.S. Cl. ..... 200/534; 200/564

(58) Field of Classification Search ..... 200/400–402, 200/410, 416, 440–442, 448, 449, 534, 536, 200/541, 542, 564, 568, 17 R, 6 R, 6 BA; 335/129–132, 202
See application file for complete search history.

(56) References Cited

U.S. PATENT DOCUMENTS 5,107,236 A 4/1992 Lesslie et al.
5,485,134 A * 1/1996 Seymour et al. ..... 335/132
5,886,641 A * 3/1999 Ulerich et al. ..... 335/17
6,040,746 A * 3/2000 Maloney et al. ..... 200/330
6,400,242 B1 * 6/2002 Fasano et al. ..... 200/18
6,476,337 B2 11/2002 Castonguay et al.
2002/0112946 A1 8/2002 Greenberg et al.
2002/0117387 A1 8/2002 Castonguary et al.

FOREIGN PATENT DOCUMENTS

DE 40 23 655 A1 9/1991
DE 198 60 042 A1 7/2000
EP 1 030 336 A2 8/2000
WO 02/07174 A1 1/2002

* cited by examiner

*Primary Examiner*—Renee S Luebke
*Assistant Examiner*—Marina Fishman
(74) *Attorney, Agent, or Firm*—Buchanan Ingersoll & Rooney PC

(57) ABSTRACT

An auxiliary contact configuration for a switching device, the switching device comprising a frame part (2) and the auxiliary contact configuration comprising a first auxiliary contact position (5) provided in the frame part (2) and arranged to receive an auxiliary contact (8), and a movable auxiliary contact control device (10) comprising a first control element (11) arranged to control the auxiliary contact (8) installed in the first position (5). The auxiliary contact configuration comprises a second auxiliary contact position (6) provided near the first auxiliary contact position (5), and the auxiliary contact control device (10) comprises a second control element (12) arranged to control the auxiliary contact (8) installed in the second position (6) in a manner different from the manner in which the first control element (11) is arranged to control the auxiliary contact (8) installed in the first position (5).

5 Claims, 2 Drawing Sheets

AUXILIARY CONTACT CONFIGURATION FOR SWITCHING DEVICE

BACKGROUND OF THE INVENTION

The invention relates to auxiliary contact configurations for a switching device.

Switching devices are equipment used for opening and closing a current circuit. A switching device comprises at least one pole and a control device arranged to open and close the pole. Switching devices include e.g. switches and switch-fuses. Switching devices often comprise auxiliary contacts arranged to open and close e.g. locking, alarming, position indication and auxiliary current circuits. Auxiliary contacts are adapted for currents substantially lower than said at least one pole of a switching device. Auxiliary contacts are controlled by an auxiliary contact control device which, in turn, is usually controlled by the same control device as used for controlling the poles of the switching device.

An auxiliary contact configuration may comprise an auxiliary contact, which is in its first switching position when the control device for the switching device is in a 0-position or in a I-position, and in its second switching position when the control device for the switching device is in a testing position. Alternatively, the auxiliary contact configuration may comprise e.g. an auxiliary contact, which is in its first switching position when the control device for the switching device is in the 0-position, and in its second switching position when the control device for the switching device is in the I-position or in the testing position. A desired change of position of each auxiliary contact of the switching device between its first and second switching position is achieved by designing the auxiliary contact control device appropriately.

A problem with the above-described arrangement is that the auxiliary contact control device has to be designed differently for different configurations, depending on the way in which each auxiliary contact is to change its position between the first and the second position.

BRIEF DESCRIPTION OF THE INVENTION

An object of the invention is to provide an auxiliary contact configuration for a switching device to enable the above-mentioned problems to be solved. The object of the invention is achieved by an auxiliary contact configuration for a switching device which is characterized by what is disclosed in the independent claim. Preferred embodiments of the invention are disclosed in the dependent claims.

The idea underlying the invention is that the auxiliary contact configuration comprises two auxiliary contact positions situated near one another, and the auxiliary contact control device comprises one control element for each said auxiliary contact position such that the control device is arranged to control the auxiliary contact installed in the first position in a manner different from the manner in which the auxiliary contact installed in the second position is controlled.

An advantage of the auxiliary contact configuration for a switching device according to the invention is that it enables the installation location of the auxiliary contact to influence the manner in which the auxiliary contact changes its position between the first and the second switching position when the auxiliary contact control device is moved. Consequently, the same components enable formation of auxiliary contact configurations which operate in a different manner.

BRIEF DESCRIPTION OF THE DRAWINGS

The invention is now described in closer detail in connection with the preferred embodiments and with reference to the accompanying drawings, in which.

DETAILED DESCRIPTION OF THE INVENTION

Figure 1:
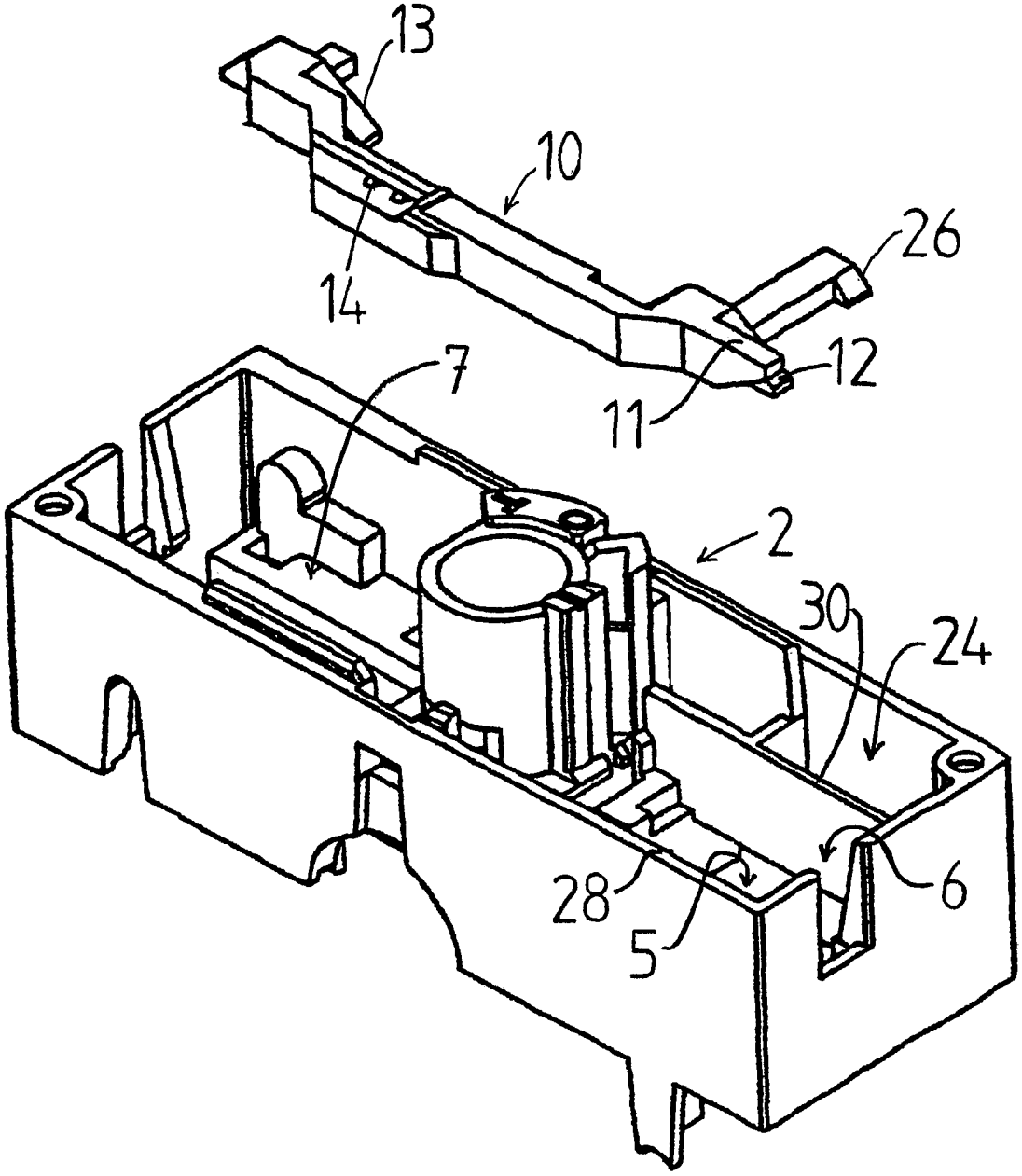
FIG. 1 shows components of an auxiliary contact configuration according to an embodiment of the invention.

The auxiliary contact configuration of FIG. 1 comprises a first 5, a second 6 and a third 7 auxiliary contact position provided in a frame part 2 of a control device for a switching device, and a movable auxiliary contact control device 10. The auxiliary contact control device 10 comprises a first 11, a second 12 and a third 13 control element arranged to control auxiliary contacts installed in the first 5, the second 6 and the third 7 auxiliary contact position, respectively.

Figure 2:
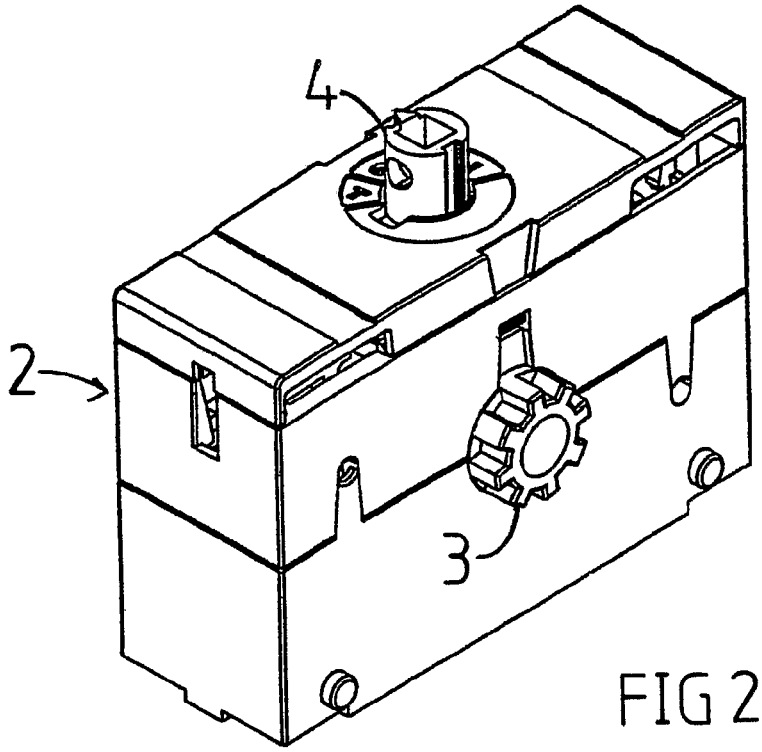
FIG. 2 shows a control device module for a switching device, which comprises the components of an auxiliary contact configuration according to FIG. 1.

FIG. 2 shows a control module for a modular switching device, which comprises the components shown in FIG. 1. A rotatable control shaft 4 is arranged both to move the auxiliary contact control device 10 and to rotate a working shaft 3 arranged to change the position of the poles (not shown) of the switching device. The control shaft 4 comprises toothed means arranged to co-operate together with a toothed bar 14 of the auxiliary contact control device 10 in order to move the control device 10.

Each position of the control device corresponds with a certain rotation angle of the control shaft 4. The control device module according to FIG. 2 is arranged such that rotating the control shaft 4 by 90° clockwise from a 0-position produces an I-position of the control device, and rotating the control shaft 4 by 45° anticlockwise from the 0-position produces a test position of the control device.

Figure 3:
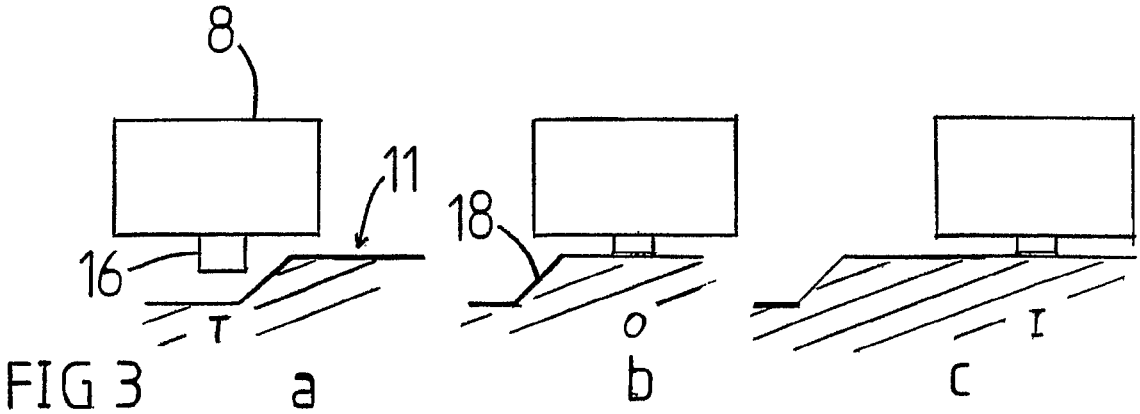
FIGS. 3*a* to 3*c* show switching positions of an auxiliary contact installed in a first auxiliary contact position of the auxiliary contact configuration of FIG. 1 in different positions of a control device for a switching device.
Figure 4:
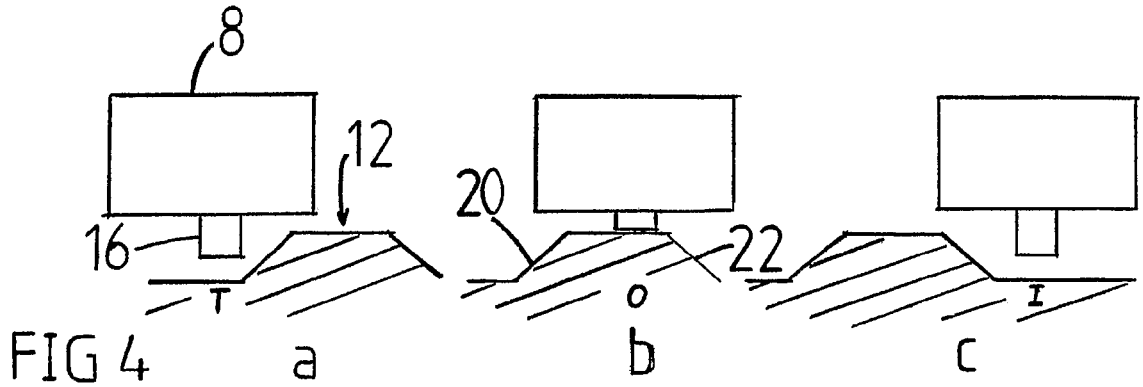
FIGS. 4*a* to 4*c* show switching positions of an auxiliary contact installed in a second auxiliary contact position of the auxiliary contact configuration of FIG. 1 in different positions of a control device for a switching device.

FIGS. 3*a* to 3*c* show switching positions of an auxiliary contact 8 installed in a first auxiliary contact position 5 of the auxiliary contact configuration of FIG. 1 in different positions of a control device for a switching device, and FIGS. 4*a* to 4*c* show switching positions of an auxiliary contact 8 installed in a second auxiliary contact position 6 in corresponding positions of the control device for the switching device.

When the control device for the switching device is in a testing position T, a push button 16 of the auxiliary contact 8 installed in the first auxiliary contact position 5 is in its outer position, as shown in FIG. 3*a*. When the control device for the switching device is moved from the T-position to a 0-position, a slope 18 of a first control element 11 pushes the push button 16 of the auxiliary contact 8 inwards. When the control device for the switching device is in the 0-position, the push button 16 of the auxiliary contact 8 is in its inner position, as shown in FIG. 3*b*. When the control device for the switching device is moved from the 0-position to an I-position, the push button 16 of the auxiliary contact 8 remains in its inner position.

When the control device for the switching device is in the I-position, the push button 16 of the auxiliary contact 8 is in its inner position, as shown in FIG. 3*c*.

When the control device for the switching device is in a testing position T, a push button 16 of an auxiliary contact 8 installed in the second auxiliary contact position 6 is in its outer position, as shown in FIG. 4*a*. When the control device for the switching device is moved from the T-position to a 0-position, a slope 20 of a second control element 12 pushes the push button 16 of the auxiliary contact 8 inwards. When the control device for the switching device is in the 0-position, the push button 16 of the auxiliary contact 8 is in its inner position, as shown in FIG. 4*b*. When the control device for the switching device is moved from the 0-position to an I-position, a slope 22 of the second control element 12 allows the push button 16 of the auxiliary contact 8 to protrude outwards. When the control device for the switching device is in the I-position, the push button 16 of the auxiliary contact 8 is in its outer position, as shown in FIG. 4*c*.

In the described embodiment, the auxiliary contact 8 is arranged such that in a switching state wherein the push button 16 is in its outer position, the current circuit coupled to the auxiliary contact 8 is closed. Similarly, in a switching state wherein the push button 16 is in its inner position, the current circuit coupled to the auxiliary contact 8 is open.

In addition to auxiliary contacts 8, the auxiliary contact configuration may be arranged to receive microswitches. The configuration of FIG. 1 comprises one microswitch position 24. The auxiliary contact control device 10 is provided with a microswitch control element 26 arranged to control a microswitch installed in the microswitch position 24. The microswitch control element 26 operates in a manner substantially similar to that in which the auxiliary contact control elements 11, 12 and 13 do, i.e. it changes the position of the push button of the microswitch between an outer and an inner position by means of appropriately designed slopes.

The microswitch position 24 is arranged to receive a microswitch whose push button is situated slightly nearer one end. The location of the push button of the microswitch installed in position 24 depends on which way around the microswitch has been installed in the position. The microswitch control element 26 is arranged such that depending on the installation direction of the microswitch, the push button of the microswitch is pressed down either in the 0-position or in the testing position of the control device for the switching device.

The auxiliary contact configuration for a switching device according to FIG. 1 is provided in a control device module for a modular switching device. The auxiliary contact configuration of the invention may also be provided in a separate auxiliary contact module or, if desired, even in a pole cell module. The auxiliary contact configuration of the invention may also be provided in a switching device wherein all components are installed in the same frame part. In embodiments wherein the auxiliary contact control device 10 cannot or will not be controlled by the control shaft of the switching device, control may be implemented e.g. by means of a working shaft 3.

In the auxiliary contact configuration of the invention, auxiliary contacts 8 having two or more switching positions may be used.

The elongated auxiliary contact control device 10 of the configuration of FIG. 1 is arranged to move substantially linearly. The auxiliary contact control device 10 is preferably provided as one piece made e.g. from a plastics material by injection moulding.

In the configuration of FIG. 1, the positions 5 and 6 are arranged to receive an auxiliary contact 8 whose width is about 2.0 cm. The combined width of the first 5 and the second 6 auxiliary contact position is about 2.2 cm. The first 5 and the second 6 auxiliary contact positions thus overlap so as to allow the auxiliary contact 8 to be installed either in the first auxiliary contact position 5 or in the second auxiliary contact position 6 only. If an auxiliary contact 8 has been installed in the first position 5, no auxiliary contact can be installed in the second position 6. Similarly, if an auxiliary contact 8 has been installed in the second position 6, no auxiliary contact can be installed in the first position 5.

When the auxiliary contact 8 has been installed in the first position 5, its one side resides adjacent to a first wall 28 of the frame part 2. When the auxiliary contact 8 has been installed in the second position 6, its other side resides adjacent to a second wall 30 of the frame part 2, opposite to the first wall 28. Each of the auxiliary contact control elements 11, 12 and 13 has a width of about 2 mm, so that the push button 16 of the auxiliary contact 8 falls substantially at a middle of the first control element 11 when the auxiliary contact is installed in the first position 5, and in a middle of the second control element 12 when the auxiliary contact is installed in the second position 6.

In an alternative embodiment, the first 5 and the second 6 auxiliary contact positions are juxtaposed such that each position may simultaneously be provided with an auxiliary contact 8. Such a configuration may be used when the size of the switching device does not have to be minimized.

It is obvious to one skilled in the art that the basic idea of the invention can be implemented in many different ways. The invention and its embodiments are thus not restricted to the above-described examples but may vary within the scope of the claims.

The invention claimed is:

1. An auxiliary contact configuration for a switching device, the switching device comprising:

a frame part, and the auxiliary contact configuration comprising a first auxiliary contact position provided in the frame part and configured to receive an auxiliary contact; and a movable auxiliary contact control device comprising a first control element arranged to control the auxiliary contact when installed in the first position, wherein the auxiliary contact configuration comprises a second auxiliary contact position provided near the first auxiliary contact position, and the auxiliary contact control device comprises a second control element arranged to control the auxiliary contact, when installed in the second position, in a manner different from a manner in which the first control element is arranged to control the auxiliary contact when installed in the first position;

wherein the first auxiliary contact position and the second auxiliary contact position overlap so as to allow the auxiliary contact to be installed either in the first auxiliary contact position or in the second auxiliary contact position only.

2. The auxiliary contact configuration as claimed in claim 1 wherein the control elements comprise slopes.

3. The auxiliary contact configuration as claimed in claim 1 wherein the auxiliary contact configuration comprises a microswitch position provided in the frame part, and that the auxiliary contact control device is provided with a microswitch control element arranged to control a microswitch installed in the microswitch position.

4. The auxiliary contact configuration as claimed in claim 1, wherein the auxiliary contact control device is arranged to move substantially linearly.

5. An auxiliary contact configuration for a switching device, the switching device comprising:

a frame part, and the auxiliary contact configuration comprising a first auxiliary contact position provided in the frame part and configured to receive an auxiliary contact; and a movable auxiliary contact control device comprising a first control element configured to control the auxiliary contact when installed in the first position, wherein the auxiliary contact configuration comprises a second auxiliary contact position provided near the first auxiliary contact position, and the auxiliary contact control device comprises a second control element arranged to control the auxiliary contact, when installed in the second position, in a manner different from a manner in which the first control element is arranged to control the auxiliary contact when installed in the first position;

wherein the auxiliary contact control device is equipped with a toothed bar and a control shaft of the switching device is arranged to co-operate together with the toothed bar of the control device in order to move the control device.

* * * * *